US010194711B2

(12) United States Patent
Dua et al.

(10) Patent No.: US 10,194,711 B2
(45) Date of Patent: Feb. 5, 2019

(54) PACKAGED DYED KNITTED COMPONENT

(71) Applicant: NIKE, Inc., Beaverton, OR (US)

(72) Inventors: Bhupesh Dua, Portland, OR (US); Karen Hawkinson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 889 days.

(21) Appl. No.: 14/270,521

(22) Filed: May 6, 2014

(65) Prior Publication Data

US 2015/0320136 A1 Nov. 12, 2015

(51) Int. Cl.

| | |
|---|---|
| ***D04B 1/22*** | (2006.01) |
| ***A43B 1/04*** | (2006.01) |
| ***A43B 23/02*** | (2006.01) |
| ***D04B 1/16*** | (2006.01) |
| ***D04B 1/24*** | (2006.01) |
| ***D04B 1/12*** | (2006.01) |

(52) U.S. Cl.

CPC ..... *A43B 1/04* (2013.01); *A43B 23/02* (2013.01); *A43B 23/0245* (2013.01); *D04B 1/12* (2013.01); *D04B 1/16* (2013.01); *D04B 1/24* (2013.01); *D10B 2501/043* (2013.01)

(58) Field of Classification Search

CPC ... D04B 1/22; D04B 7/24; D04B 7/26; D04B 7/28; D04B 7/30; D04B 7/32

See application file for complete search history.

(56) References Cited

U.S. PATENT DOCUMENTS

| | | | |
|---|---|---|---|
| 601,192 | A | 3/1898 | Woodside |
| 1,215,198 | A | 2/1917 | Rothstein |
| 1,597,934 | A | 8/1926 | Stimpson |
| 1,888,172 | A | 11/1932 | Joha |
| 1,902,780 | A | 3/1933 | Holden et al. |
| 1,910,251 | A | 5/1933 | Joha |
| 2,001,293 | A | 5/1935 | Wilson |
| 2,047,724 | A | 7/1936 | Zuckerman |
| 2,147,197 | A | 2/1939 | Glidden |
| 2,314,098 | A | 3/1943 | McDonald |
| 2,330,199 | A | 9/1943 | Basch |
| 2,343,390 | A | 3/1944 | Ushakoff |
| 2,400,692 | A | 5/1946 | Herbert |
| 2,440,393 | A | 4/1948 | Clark |
| 2,569,764 | A | 10/1951 | Jonas |

(Continued)

FOREIGN PATENT DOCUMENTS

| | | |
|---|---|---|
| DE | 870963 C | 3/1953 |
| DE | 1084173 | 6/1960 |

(Continued)

OTHER PUBLICATIONS

Letter from Bruce Huffa dated Dec. 23, 2013 (71 Pages).

(Continued)

*Primary Examiner* — Danny Worrell

(74) *Attorney, Agent, or Firm* — Brinks Gilson & Lione

(57) ABSTRACT

A method of manufacturing an article of footwear includes providing a yarn that is at least partially package dyed. The method also includes flat knitting a knitted component at least partially from the yarn. The knitted component has an area with a density of at least twenty-eight courses per inch (28 CPI). Moreover, the method includes forming at least a portion of an upper of the article of footwear with the knitted component.

7 Claims, 12 Drawing Sheets

(56) References Cited

U.S. PATENT DOCUMENTS

| | | | | |
|---|---|---|---|---|
| 2,586,045 | A | 2/1952 | Hoza | |
| 2,608,078 | A | 8/1952 | Anderson | |
| 2,641,004 | A | 6/1953 | Whiting et al. | |
| 2,675,631 | A | 4/1954 | Doughty | |
| 2,994,322 | A | 8/1961 | Cullen et al. | |
| 3,583,081 | A | 6/1971 | Hayashi | |
| 3,694,940 | A | 10/1972 | Stohr | |
| 3,704,474 | A | 12/1972 | Winkler | |
| 3,766,566 | A | 10/1973 | Tadokoro | |
| 3,778,856 | A | 12/1973 | Christie et al. | |
| 3,940,917 | A | 3/1976 | Strachan | |
| 3,952,427 | A | 4/1976 | Von den Benken et al. | |
| 3,972,086 | A | 8/1976 | Belli et al. | |
| 4,027,402 | A | 6/1977 | Liu et al. | |
| 4,031,586 | A | 6/1977 | Von den Benken et al. | |
| 4,086,688 | A * | 5/1978 | Dombrowski | D06B 11/0036 28/218 |
| 4,211,806 | A | 7/1980 | Civardi et al. | |
| 4,232,458 | A | 11/1980 | Bartels | |
| 4,255,949 | A | 3/1981 | Thorneburg | |
| 4,258,480 | A | 3/1981 | Famolare, Jr. | |
| 4,317,292 | A | 3/1982 | Melton | |
| 4,373,361 | A | 2/1983 | Thorneburg | |
| 4,447,967 | A | 5/1984 | Zaino | |
| 4,465,448 | A | 8/1984 | Aldridge | |
| 4,607,439 | A | 8/1986 | Harada | |
| 4,737,396 | A | 4/1988 | Kamat | |
| 4,750,339 | A | 6/1988 | Simpson et al. | |
| 4,756,098 | A | 7/1988 | Boggia | |
| 4,785,558 | A * | 11/1988 | Shiomura | A43B 1/04 36/114 |
| 4,813,158 | A | 3/1989 | Brown | |
| 5,031,423 | A | 7/1991 | Ikenaga | |
| 50,957,520 | | 3/1992 | Tibbals, Jr. | |
| 5,117,567 | A | 6/1992 | Berger | |
| 5,125,116 | A * | 6/1992 | Gaither | A41B 11/00 2/239 |
| 5,152,025 | A | 10/1992 | Hirmas | |
| 5,192,601 | A | 3/1993 | Neisler | |
| 5,345,638 | A | 9/1994 | Nishida | |
| 5,353,524 | A | 10/1994 | Brier | |
| 5,371,957 | A | 12/1994 | Gaudio | |
| 5,461,884 | A | 10/1995 | McCartney et al. | |
| 5,511,323 | A | 4/1996 | Dahlgren | |
| 5,572,860 | A | 11/1996 | Mitsumoto et al. | |
| 5,575,090 | A | 11/1996 | Condini | |
| 5,623,840 | A | 4/1997 | Roell | |
| 5,729,918 | A | 3/1998 | Smets | |
| 5,735,145 | A | 4/1998 | Pernick | |
| 5,737,943 | A * | 4/1998 | Bernhardt | A41B 11/00 2/239 |
| 5,746,013 | A | 5/1998 | Fay, Sr. | |
| 5,765,296 | A | 6/1998 | Ludemann et al. | |
| 5,884,419 | A | 3/1999 | Davidowitz et al. | |
| 5,996,189 | A | 12/1999 | Wang | |
| 6,029,376 | A | 2/2000 | Cass | |
| 6,032,387 | A | 3/2000 | Johnson | |
| 6,052,921 | A | 4/2000 | Oreck | |
| 6,088,936 | A | 7/2000 | Bahl | |
| 6,151,802 | A | 11/2000 | Reynolds | |
| 6,170,175 | B1 | 1/2001 | Funk | |
| 6,308,438 | B1 | 10/2001 | Throneburg et al. | |
| 6,333,105 | B1 | 12/2001 | Tanaka et al. | |
| 6,401,364 | B1 | 6/2002 | Burt | |
| 6,558,784 | B1 | 5/2003 | Norton et al. | |
| 6,588,237 | B2 | 7/2003 | Cole et al. | |
| 6,754,983 | B2 | 6/2004 | Hatfield et al. | |
| 6,910,288 | B2 | 6/2005 | Dua | |
| 6,922,917 | B2 | 8/2005 | Kerns et al. | |
| 6,931,762 | B1 | 8/2005 | Dua | |
| D517,297 | S | 3/2006 | Jones et al. | |
| 7,051,460 | B2 | 5/2006 | Orei et al. | |
| 7,056,402 | B2 | 6/2006 | Koerwien et al. | |
| 7,347,011 | B2 | 2/2008 | Dua et al. | |
| 7,441,348 | B1 | 10/2008 | Dawson | |
| 7,543,397 | B2 | 6/2009 | Kilgore et al. | |
| 7,568,298 | B2 | 8/2009 | Kerns | |
| 7,682,219 | B2 | 3/2010 | Falla | |
| 8,065,894 | B2 * | 11/2011 | Yanagi | D04B 1/18 66/169 R |
| 8,490,299 | B2 * | 7/2013 | Dua | A43B 1/04 36/45 |
| 2002/0075599 | A1 | 6/2002 | Delgorgue et al. | |
| 2002/0148258 | A1 | 10/2002 | Cole et al. | |
| 2003/0126762 | A1 | 7/2003 | Tseng | |
| 2003/0191427 | A1 | 10/2003 | Jay et al. | |
| 2004/0118018 | A1 | 6/2004 | Dua | |
| 2004/0181972 | A1 | 9/2004 | Csorba | |
| 2005/0115284 | A1 | 6/2005 | Dua | |
| 2005/0193592 | A1 | 9/2005 | Dua et al. | |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0162187 | A1 | 7/2006 | Byrnes et al. | |
| 2007/0022627 | A1 | 2/2007 | Sokolowski et al. | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110048 | A1 | 5/2008 | Dua et al. | |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2011/0030244 | A1 | 2/2011 | Motawi et al. | |
| 2011/0078921 | A1 | 4/2011 | Greene et al. | |
| 2012/0233882 | A1 | 9/2012 | Huffa et al. | |
| 2012/0234052 | A1 | 9/2012 | Dua et al. | |
| 2012/0255201 | A1 * | 10/2012 | Little | A43B 1/04 36/84 |
| 2013/0269209 | A1 * | 10/2013 | Lang | A43B 23/0205 36/45 |
| 2014/0053610 | A1 * | 2/2014 | Fukui | D04B 1/102 66/183 |
| 2014/0245633 | A1 * | 9/2014 | Podhajny | A43B 1/04 36/45 |

FOREIGN PATENT DOCUMENTS

| | | | |
|---|---|---|---|
| DE | 19738433 | | 4/1998 |
| DE | 19728848 | | 1/1999 |
| EP | 0279950 | A2 | 8/1988 |
| EP | 0448714 | | 7/1996 |
| EP | 0728860 | | 8/1996 |
| EP | 0758693 | | 2/1997 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| NL | 7304678 | | 10/1974 |
| WO | 9003744 | | 4/1990 |
| WO | 0032861 | | 6/2000 |
| WO | 0231247 | | 4/2002 |

OTHER PUBLICATIONS

Declaration of Dr. Edward C. Frederick from the US Patent and Trademark Office Inter Partes Review of U.S. Pat. No. 7,347,011 (178 pp).

(56) References Cited

OTHER PUBLICATIONS

David J. Spencer, Knitting Technology: A Comprehensive Handbook and Practical Guide (Third ed., Woodhead Publishing Ltd. 2001) (413 pp).
Excerpt of Hannelore Eberle et al., Clothing Technology (Third English ed., Beuth-Verlag GmnH 2002) (book cover and back; pp. 2-3, 83).
International Search Report and Written Opinion in connection with PCT/US2009/056795 dated Apr. 20, 2010.
International Search Report and Written Opinion in connection with PCT/US2012/028576 dated Oct. 1, 2012.
International Search Report and Written Opinion in connection with PCT/US2012/028559 dated Oct. 19, 2012.
International Search Report and Written Opinion in connection with PCT/US2012/028534 dated Oct. 17, 2012.
International Preliminary Report on Patentability in connection with PCT/US2012/028534 dated Sep. 17, 2013.
International Preliminary Report on Patentability in connection with PCT/US2012/028576 dated Sep. 17, 2013.

* cited by examiner

PACKAGED DYED KNITTED COMPONENT

BACKGROUND

The present disclosure relates generally to knitted components, and, in particular, to a knitted component at least partially formed from package dyed yarns.

Conventional articles of footwear generally include two primary elements: an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally used in manufacturing the upper. In athletic footwear, for example, the upper may have multiple layers that each includes a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements.

By decreasing the number of material elements used in the upper, therefore, waste may be decreased while increasing the manufacturing efficiency and recyclability of the upper.

Uppers that include knitted components have been proposed to address these concerns. The knitted component can include a predetermined number of yarns, strands, filaments, fibers, wires, threads, composite yarns, and/or other suitable knitting materials, that are knitted together to define at least a portion of the upper. Accordingly, the knitted component and, thus, the upper can be manufactured in an efficient manner. Also, including the knitted component in the upper can reduce waste, and the knitted component can provide the upper with attractive aesthetic properties.

Typically, the yarns or strands included in knitted components are solution dyed to provide the yarns with a desirable color. More specifically, in a solution dyeing process, the yarns are extruded from colored pellets of polymeric material. The extruded yarns, thus, get their color from the pellets themselves. However, producing colored yarns through the solution dyeing process can be relatively expensive and labor intensive. Thus, there is a need for improved methods of forming knitted components with colored yarns.

SUMMARY

A method of manufacturing an article of footwear is disclosed. The method includes providing a yarn that is at least partially package dyed. The method also includes flat knitting a knitted component at least partially from the yarn. The knitted component has an area with a density of at least twenty-eight courses per inch (28 CPI). Moreover, the method includes forming at least a portion of an upper of the article of footwear with the knitted component.

An article of footwear is additionally disclosed. The article of footwear includes a sole assembly and an upper that is attached to the sole assembly. The upper includes a flat knitted component that is formed of unitary knit construction. The flat knitted component includes an area that is formed from a yarn. The yarn is at least partially package dyed. The area has a density of at least twenty-eight courses per inch (28 CPI).

Moreover, a method of manufacturing an article of footwear is disclosed. The method includes providing a covering strand and texturizing the covering strand. The method further includes package dyeing the covering strand after texturizing the covering strand. Also, the method includes re-texturizing the covering strand after package dyeing the covering strand. Furthermore, the method includes air covering the covering strand over a core strand to form a composite yarn. The method additionally includes flat knitting a flat knitted component at least partially from the composite yarn and forming the article of footwear from the knitted component.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The following discussion and accompanying figures disclose a variety of concepts relating to knitted components and the manufacture of knitted components. Although the knitted components may be used in a variety of products, an article of footwear that incorporates at least one knitted component is disclosed below as an example. In addition to footwear, the knitted components may be used in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be used in bed coverings (e.g., sheets, blankets), table coverings, towels, flags, tents, sails, and parachutes. The knitted components may be used as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

Discussion of Knitted Components

The Figures illustrate various embodiments of knitted components, yarns that are incorporated in the knitted component, and methods and devices for manufacturing the yarns and the knitted components. It will be understood that the term "yarn" will be interpreted broadly to mean any strand, fiber, filament, wire, rope, thread and/or other suitable knitting material. The term "yarn" will also be interpreted broadly to include a grouping of two or more yarns, fibers, filaments, or strands that are coupled together to define a single composite yarn.

Figure 1:
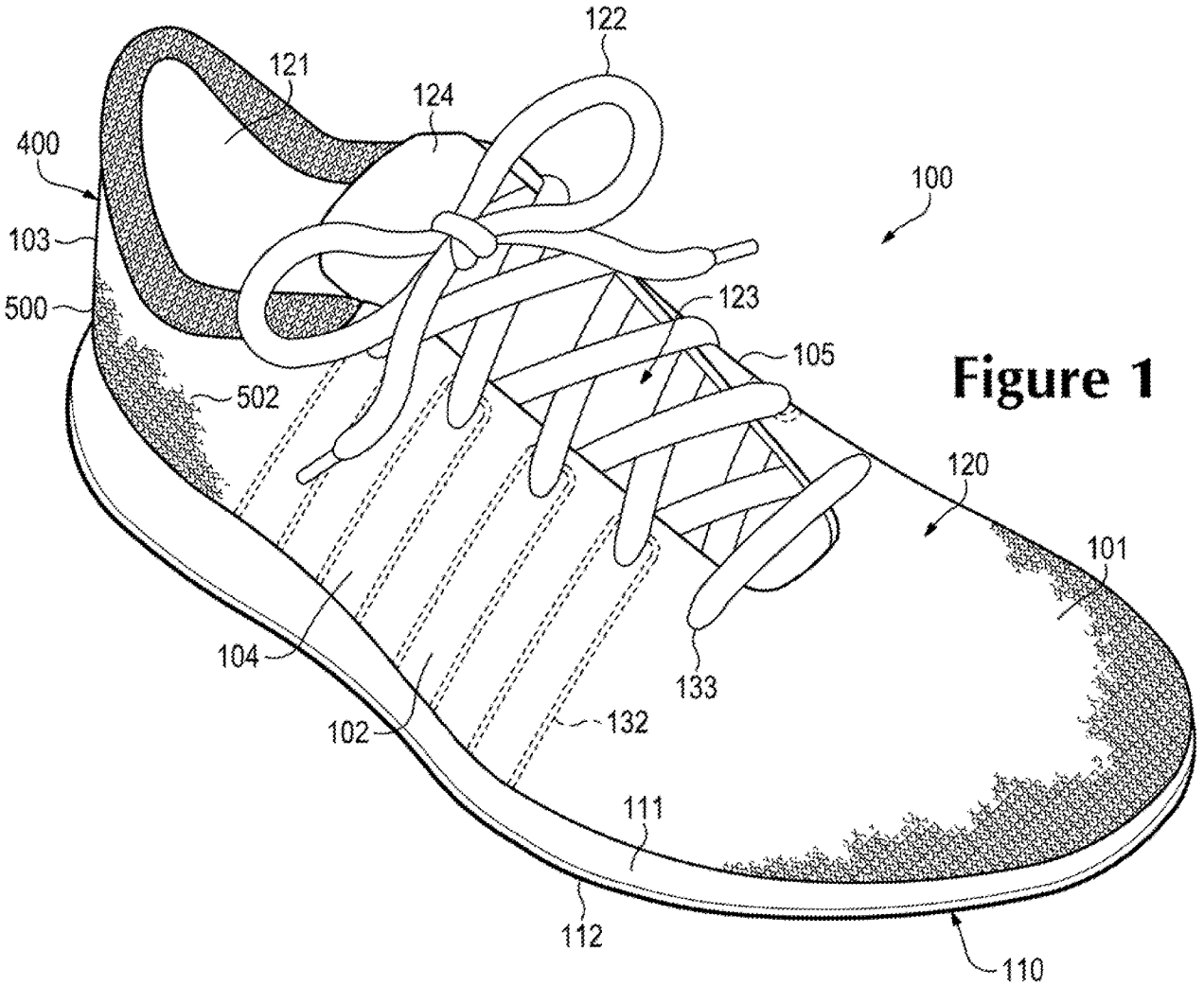
FIG. 1 is a perspective view of an article of footwear that includes a knitted component according to exemplary embodiments of the present disclosure.

FIGS. 1 through 5 illustrate exemplary embodiments of a knitted component 400 according to exemplary embodiments of the present disclosure. As shown in FIG. 1, the knitted component 400 can be incorporated in an article of footwear 100; however, it will be appreciated that the knitted component 400 could be incorporated in any other suitable object. The knitted component 400 can be formed from one or more yarns 500 as shown in FIGS. 2 through 5. The yarns 500 can be knitted together to define a plurality of stitches 502.

As shown in the embodiment of FIG. 1, the knitted component 400 can be incorporated into an article of footwear 100. The knitted component 400 can form at least part of an upper 120 of the article of footwear 100, and the upper 120 can be joined to a sole structure 110. Although footwear 100 is illustrated as having a general configuration suitable for running, concepts associated with footwear 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 100 may be applied to a wide variety of footwear types.

For reference purposes, footwear 100 may be divided into three general regions: a forefoot region 101, a midfoot region 102, and a heel region 103, as shown in FIG. 1. Forefoot region 101 can generally include portions of footwear 100 corresponding with the toes and the joints connecting the metatarsals with the phalanges. Midfoot region 102 can generally include portions of footwear 100 corresponding with an arch area of the foot. Heel region 103 can generally correspond with rear portions of the foot, including the calcaneus bone. Footwear 100 can also include a lateral side 104 and a medial side 105, which extend through each of forefoot region 101, midfoot region 102, and heel region 103 and can correspond with opposite sides of footwear 100. More particularly, lateral side 104 can correspond with an outside area of the foot (i.e. the surface that faces away from the other foot), and medial side 105 can correspond with an inside area of the foot (i.e., the surface that faces toward the other foot). Forefoot region 101, midfoot region 102, heel region 103, lateral side 104, and medial side 105 are not intended to demarcate precise areas of footwear 100. Rather, forefoot region 101, midfoot region 102, heel region 103, lateral side 104, and medial side 105 are intended to represent general areas of footwear 100 to aid in the following discussion. In addition to footwear 100, forefoot region 101, midfoot region 102, heel region 103, lateral side 104, and medial side 105 may also be applied to sole structure 110, upper 120, and individual elements thereof.

In an exemplary embodiment, sole structure 110 can be secured to upper 120 and can extend between the foot and the ground when footwear 100 is worn. In some embodiments, the primary elements of sole structure 110 can be a midsole 111, an outsole 112, and a sockliner (not shown) disposed within the interior of footwear 100. Midsole 111 can be secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other embodiments, midsole 111 may incorporate plates, moderators, fluid-filled chambers, lasting elements, or motion control members that further attenuate forces, enhance stability, or influence the motions of the foot, or midsole 111 may be primarily formed from a fluid-filled chamber. Outsole 112 can be secured to a lower surface of midsole 111 and may be formed from a wear-resistant rubber material that is textured to impart traction. The sockliner can be located within upper 120 and can be positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

Upper 120 can define a void within footwear 100 for receiving and securing a foot relative to sole structure 110. The void can be shaped to accommodate the foot and can extend along a lateral side of the foot, along a medial side of the foot, over the foot, around the heel, and under the foot. Access to the void is provided by an ankle opening 121 located in at least heel region 103. In some embodiments, a throat area 123 can extend from ankle opening 121 in heel region 103 over an area corresponding to an instep of the foot to an area adjacent to forefoot region 101. In an exemplary embodiment, an inlaid tensile element 132 may be associated with portions of upper 120, as will be described in more detail below. In one embodiment, inlaid tensile element 132 can extend from sole structure 110 to an area adjacent to throat area 123 and may be associated with portions of lateral side 104 and/or medial side 105 of upper 120.

A lace 122 can extend through various lace apertures 133 in upper 120 and/or looped portions of tensile element 132. Lace 122 can permit the wearer to modify dimensions of upper 120 to accommodate proportions of the foot. More particularly, lace 122 can permit the wearer to tighten upper 120 around the foot, and lace 122 can permit the wearer to loosen upper 120 to facilitate entry and removal of the foot from the void (i.e., through ankle opening 121). In addition, a tongue 124 of upper 120 can extend under lace 122 to enhance the comfort of footwear 100. In further configurations, upper 120 may include additional elements, such as: (a) a heel counter in heel region 103 that enhances stability; (b) a toe guard in forefoot region 101 that is formed of a wear-resistant material; and (c) logos, trademarks, and placards with care instructions and material information.

Many conventional footwear uppers are formed from multiple material elements (e.g., textiles, polymer foam, polymer sheets, leather, synthetic leather) that are joined through stitching or bonding, for example. In contrast, at least a portion of upper 120 can be formed from knitted component 400. Also, as shown in the embodiments illustrated, the knitted component 400 can extend through each of forefoot region 101, midfoot region 102, and heel region 103, along both lateral side 104 and medial side 105, over forefoot region 101, and around heel region 103. In addition, knitted component 400 can form portions of both an exterior surface and an opposite interior surface of upper 120. As such, knitted component 400 can defines at least a portion of the void within upper 120. In some configurations, knitted component 400 may also extend under the foot. In other configurations, a strobel sock may be secured to knitted component 400 and an upper surface of a midsole, thereby forming a portion of upper 120 that extends under a sockliner.

Various embodiments of knitted components made in accordance with the principles disclosed herein may be incorporated into articles of footwear in a similar manner as the exemplary embodiment of FIG. 1. Additionally, knitted components having various features may be made in accordance with the knitting processes disclosed in one or more of commonly-owned U.S. Patent Application Publication Number 2010/0154256 of Dua et al., published on Jun. 24, 2010, entitled "Article of Footwear Having An Upper Incorporating A Knitted Component", and U.S. Patent Application Publication Number 2012/0233882 of Huffa et al., published Sep. 20, 2012, entitled "Article Of Footwear Incorporating A Knitted Component", both of which are hereby incorporated by reference in their entirety (collectively referred to herein as the "Knitted Component cases").

Knit Structure and Yarns of Knitted Component

Figure 2:
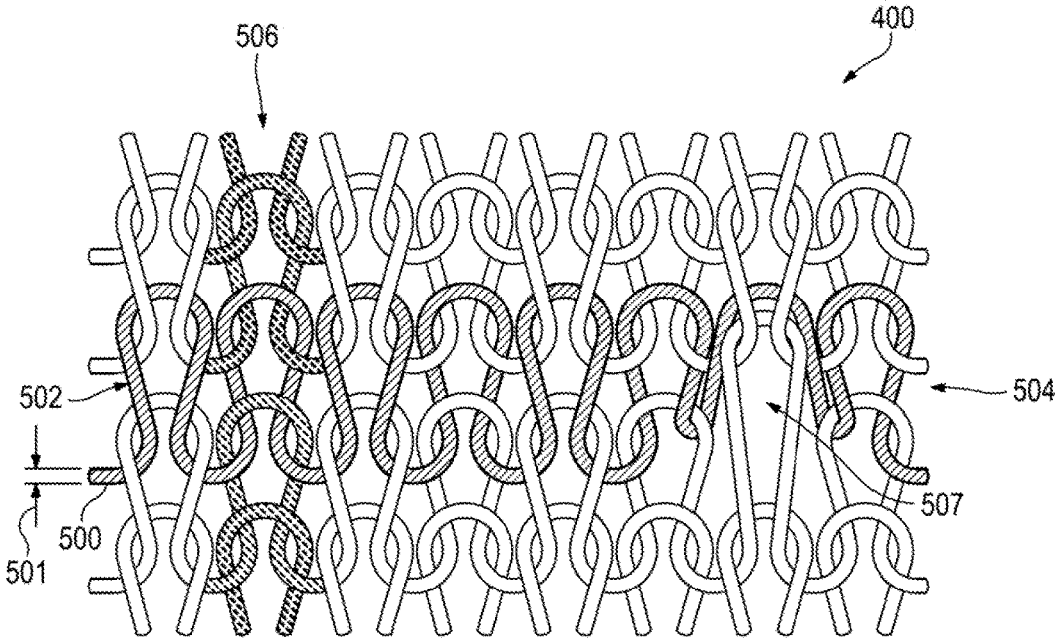
FIGS. 2-5 are detail views of various exemplary knitted components according to the present teachings.

Referring now to FIGS. 2 through 5, knitted components 400 are depicted in detail according to exemplary embodiments of the present disclosure. As shown in FIG. 2, for example, the knitted component 400 can include one or more yarns 500 that are knitted together to define a plurality of stitches 502. The stitches 502 can be of any suitable type, such as a loop stitch, a tuck stitch, a float, or other type. Specifically, as shown in the embodiment of FIG. 2, the majority of the stitches 502 can form loop stitches. In some embodiments, the stitches 502 can also define one or more tuck stitches 507 as shown in FIG. 2. However, it will be appreciated that the stitches shown in FIG. 2 are merely exemplary and any combination of one or more types of stitches may be included with the knitted component 400.

The stitches 502 can be arranged in a plurality of courses 504 and wales 506 within the knitted component 400. In the embodiments of FIG. 2, a single course is shaded for purposes of illustration and extends generally horizontally, and a single wale 506 is shaded for purposes of illustration and extends generally vertically.

The arrangement and spacing of the intermeshed stitches 502, courses 504, and/or wales 506 can affect the "density" (a.k.a. "stitch density") of the knitted component 400. For example, if adjacent stitches 502, courses 504, and/or wales 506 are closer together, then the density of the knit structure can be greater. Conversely, if the stitches 502, courses 504, and/or wales 506 are further apart, the density of the knit structure can be smaller.

More specifically, the density of the knitted component 400 can be a measurement of the number of stitches 502 per unit area of the knitted component 400. The density can also be expressed as the number of courses per inch and/or the number of wales per inch. For example, the area of the knitted component 400 shown in FIG. 2 has four courses and eight wales. Thus, the knitted component 400 of FIG. 2 can be described as having a stitch density of thirty-two stitches per the unit of area shown (4×8=32). With this configuration, the stitch density of a knitted component may be increased or decreased by a corresponding increase or decrease in the number of courses per inch and/or the number of wales per inch.

Also, in some embodiments, the density of the knitted component 400 can be described by reference to the number of courses 504 per unit area of the knitted component 400.

This measurement of courses per unit area can be useful, for example, where the knitted component 400 is a flat knitted component, where the number of wales 506 is substantially fixed. Stated differently, in a flat knitted component, the number of wales is determined by the gauge of the flat knitting machine. Specifically, a fourteen gauge flat knitting machine has fourteen needles per inch, and, thus, knitted components made on the machine have fourteen wales per inch. Accordingly, in a flat knitted component, because the number of wales is substantially fixed, any increase or decrease in stitch density is a result of a corresponding increase or decrease in the number of courses per inch. That is, for a flat knitted component, stitch density varies as a function of the number of courses per unit area, while the number of wales per unit area remains substantially constant. For example, as shown in FIG. 2, the density of the knitted component 400 can be expressed as being four courses per the unit of area shown. To increase density of the knitted component 400, the number of courses can be increased.

It will be appreciated that the knitted component 400 can have any suitable density, and the density can vary across the knitted component 400. Also, it will be appreciated that the density can affect one or more characteristics of the knitted component 400. For example, the density can affect the durability of the knitted component. The density can also affect the feel and stretchability of the knitted component 400. Moreover, the density can affect the appearance, aesthetics, or other characteristics of the knitted component 400. Accordingly, the density of the knit structure of the knitted component 400 can be predetermined to provide a desired durability, flexibility, breathability, or other characteristic.

Also, the yarns 500 of the knitted component 400 can be of any suitable type. In the embodiments of FIG. 2, the yarns 500 are depicted each as single, monofilament-type yarns 500 that extend continuously through the respective courses 504. However, it will be appreciated that each yarn 500 shown in FIG. 2 can include multiple filaments. Moreover, the yarns 500 within the knitted component 400 can have any suitable thickness, diameter, weight, denier, bulk, color, material, elasticity, tensile strength, or other qualities. In particular, the yarn 500 can have a cross-sectional thickness 501 as indicated in FIG. 2. The thickness 501 of the yarn 500 can also be referred and/or relate to the diameter of the yarn 500, the weight of the yarn 500, the denier of the yarn 500, or other characteristics of the yarn 500. In some embodiments, the thickness 501 can be at least approximately 0.30 millimeters. Accordingly, the yarn 500 can form a knitted component 400 having desirable appearance, density, durability, and/or other characteristics.

The yarns 500 can be made from wire, string, cord, various flexible filaments, strands, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. An individual filament utilized in the yarns 500 may be formed form a single material (i.e., a monocomponent filament) or from multiple materials (i.e., a bicomponent filament). Similarly, different filaments may be formed from different materials. As an example, yarns 500 may include filaments that are each formed from a common material, may include filaments that are each formed from two or more different materials, or may include filaments that are each formed from two or more different materials. Similar concepts also apply to threads, cables, ropes, etc. The thickness 501 of yarns 500 can be within a range from approximately 0.30 millimeters to 5 millimeters, for example. Also, the yarns 500 can have a substantially circular cross section, an ovate cross section, or a cross section of any other suitable shape.

As an example, one or more of the yarns 500 may be formed from a bonded nylon 6.6 with a breaking or tensile strength of 3.1 kilograms and a weight of 45 tex. One or more yarns 500 may be formed from a bonded nylon 6.6 with a breaking or tensile strength of 6.2 kilograms and a tex of 45.

In various embodiments, knitted component 400 may incorporate various types of yarns 500 that impart different properties to separate areas of the knitted component 400. That is, one area of knitted component 400 may be formed from a first type of yarn that imparts a first set of properties, and another area of the knit element may be formed from a second type of yarn 500 that imparts a second set of properties. In this configuration, properties may vary throughout the knitted component 400 by selecting specific yarns 500 for different areas of the knitted component. The properties that a particular type of yarn 500 will impart to an area of knitted component 400 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

Figure 3:
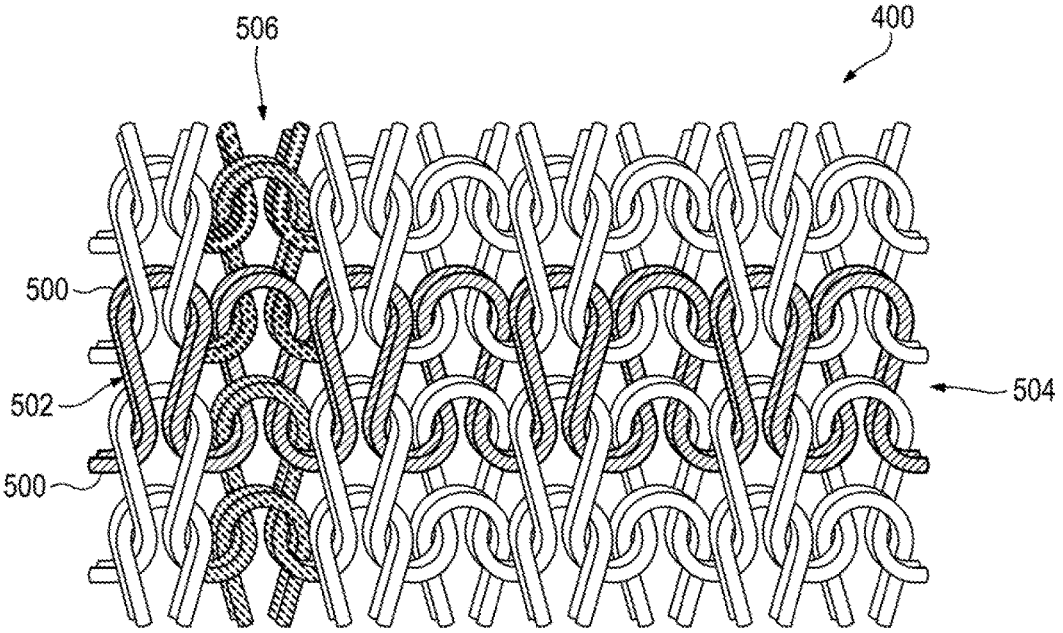

In additional embodiments represented in FIG. 3, a plurality of yarns 500 are grouped together, overlie each other, and extend generally in the same longitudinal direction through respective courses 504. In some embodiments, for example, one of the yarns 500 can be formed from at least one of a thermoset polymer material and natural fibers (e.g., cotton, wool, silk). Also, the second yarn 500 may be formed from a thermoplastic polymer material, such as a fusible yarn 500 of the type disclosed in U.S. Pat. No. 6,910,288, issued Jun. 28, 2005 to Dua, entitled "Footwear Incorporating a Textile with Fusible Filaments and Fibers," and which is hereby incorporated by reference in its entirety.

Figure 4:
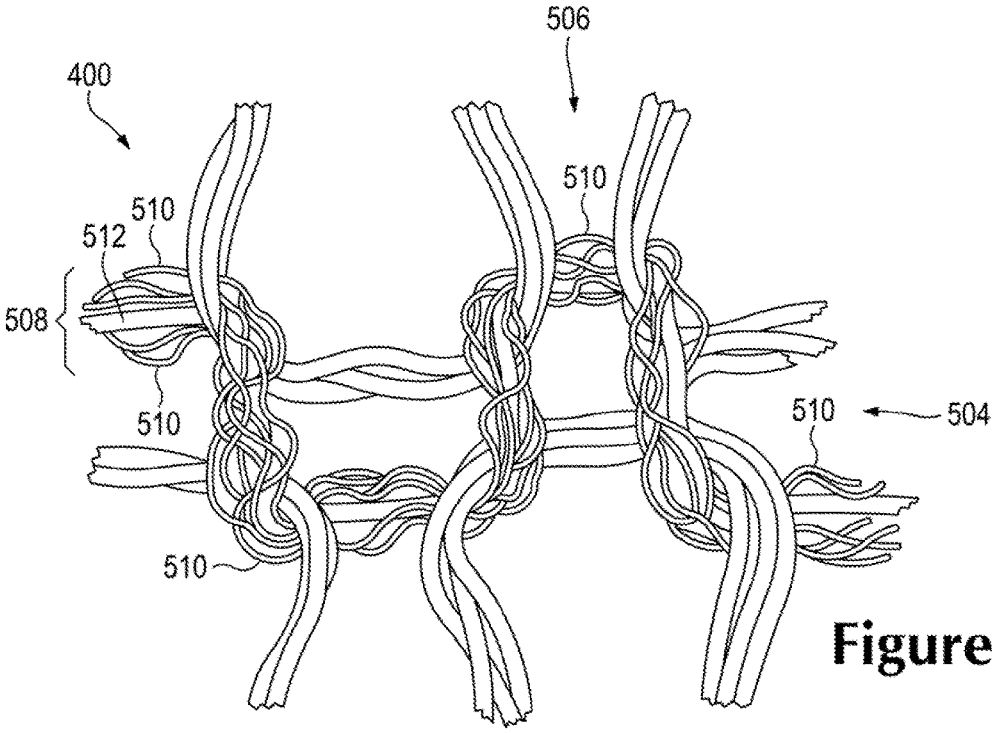
Figure 5:
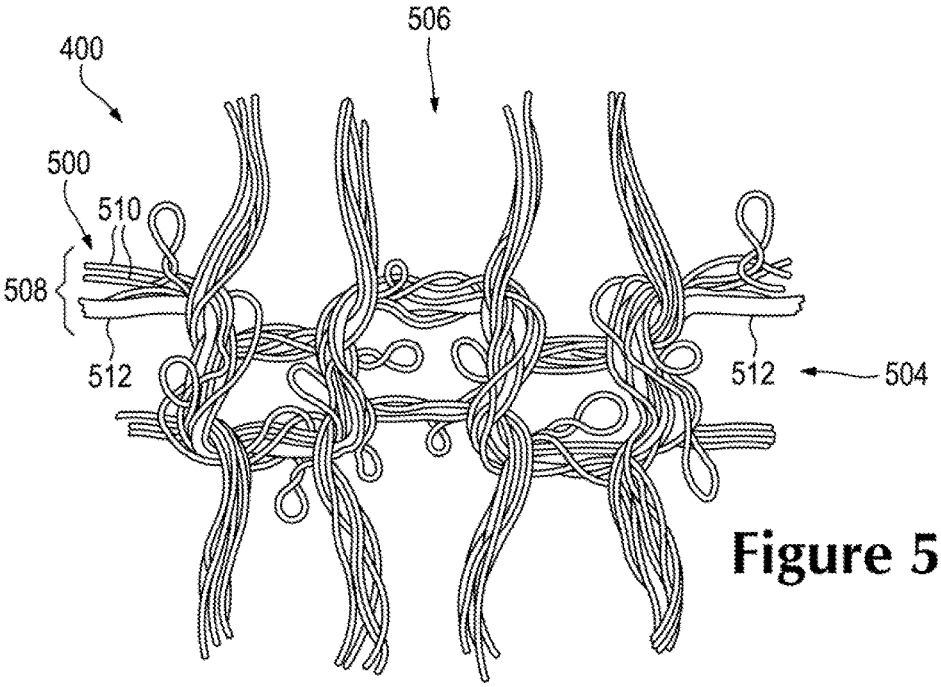

In still additional embodiments represented in FIGS. 4 and 5, one or more of the yarns 500 of the knitted component 400 can be a composite yarn 508 that includes two or more strands that are coupled together into a single yarn. For example, the composite yarn 508 can include at least one covering strand 510 and at least one core strand 512 as represented in FIGS. 4 and 5. The covering strand 510 can at least partially cover the core strand 512. In some embodiments, the composite yarn 508 can include a plurality of covering strands 510 that cooperate to at least partially cover, sheath, surround, encircle, or encapsulate the core strand 512. An exemplary embodiment of composite yarn 508 is shown independently in FIGS. 11 and 12, and composite yarns 508 are shown incorporated into the knitted component 400 in FIGS. 4 and 5.

In some embodiments, the core strand 512 can be resiliently elastic and can resiliently stretch from a first length to a second, longer length. Then, when the core strand 512 is released, the resiliency of the core strand 512 can cause the core strand 512 to recover back to its first length. For example, the core strand 512 can be made from spandex or other resiliently elastic material. Also, in some embodiments, the covering strands 510 can be relatively inelastic such that the covering strands 510 can have a substantially fixed length. For example, the covering strand 510 can be made from monofilament, fibers, or other strands of polymeric material that is relatively inelastic. Accordingly, the covering strands 510 can protect the core strand 512 from abrasion and can provide tensile strength to the composite yarn 508. The covering strands 510 can be twisted about the core strand 512 in a generally helical direction in some embodiments. In this regard, the covering strands 510 can twist about the core strand 512 in a single direction to provide a so-called "single covered" elastic yarn, or additional covering strands 510 can twist about the core strand 512 in an opposite direction to provide a so-called "double covered" elastic yarn.

Figure 12:
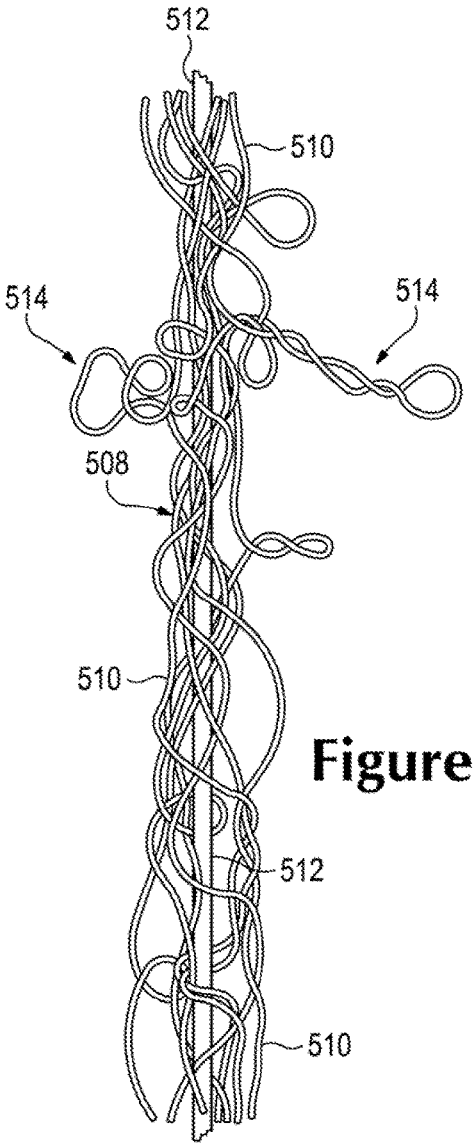
FIG. 12 is a detail view of a composite yarn according to exemplary embodiments.
Figure 13:
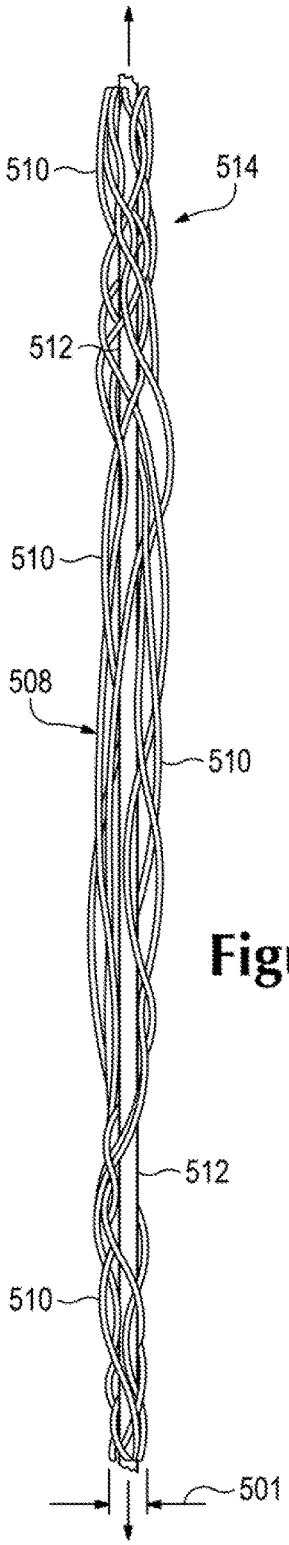
FIG. 13 is a detail view of the composite yarn of FIG. 12 being pulled in tension.

Also, as shown in FIG. 12, the covering strands 510 can include a plurality of bulked regions 514 along the longitudinal length of the yarn 508. The bulked regions 514 can provide the yarn 508 with a desirable amount of bulk in the radial direction, and the bulked regions 514 can be formed due to kinking or crimping of the covering strands 510, braiding of the covering strands 510, entanglements of the covering strands 510, and the like. When the yarn 508 is pulled in tension as shown in FIG. 13, the covering strands 510 in the bulked regions 514 can be pulled inward in the radial direction and can generally align towards the longitudinal direction. As such, the covering strands 510 can accommodate the resilient elongation of the core strand 512.

Methods of Manufacturing Knitted Component

Exemplary embodiments of methods of manufacturing the yarns 500, 508 of the knitted component 400 and methods of manufacturing the knitted component 400 will now be discussed. As will be discussed, the methods can be employed to increase manufacturability, reduce manufacturing costs, reduce waste, and to provide other advantages without reducing quality and durability of the knitted component 400.

The methods described below can relate to yarns 500, 508 that are package dyed. It will be appreciated that package dyed yarns are typically not used, for example, in knitted components that are densely knit and/or where the yarns need to be stretched during formation of a knitted component. This is because the heat, pressure, and other characteristics of the package dyeing process can be abrasive and can otherwise degrade the yarns. Specifically, the thickness, diameter, and/or bulk of the yarns can be reduced by the package dyeing process. As a result, the thickness, diameter, and/or bulk of the yarn may be too low to provide desired qualities to the knitted component. Also, in the case of a composite yarn 508, the covering strands might not include enough kink or bulk to allow elongation of the yarn 508 when knitting a densely knit area. However, methods are discussed below that allow package dyed yarns to be incorporated into such knitted components.

Figure 6:
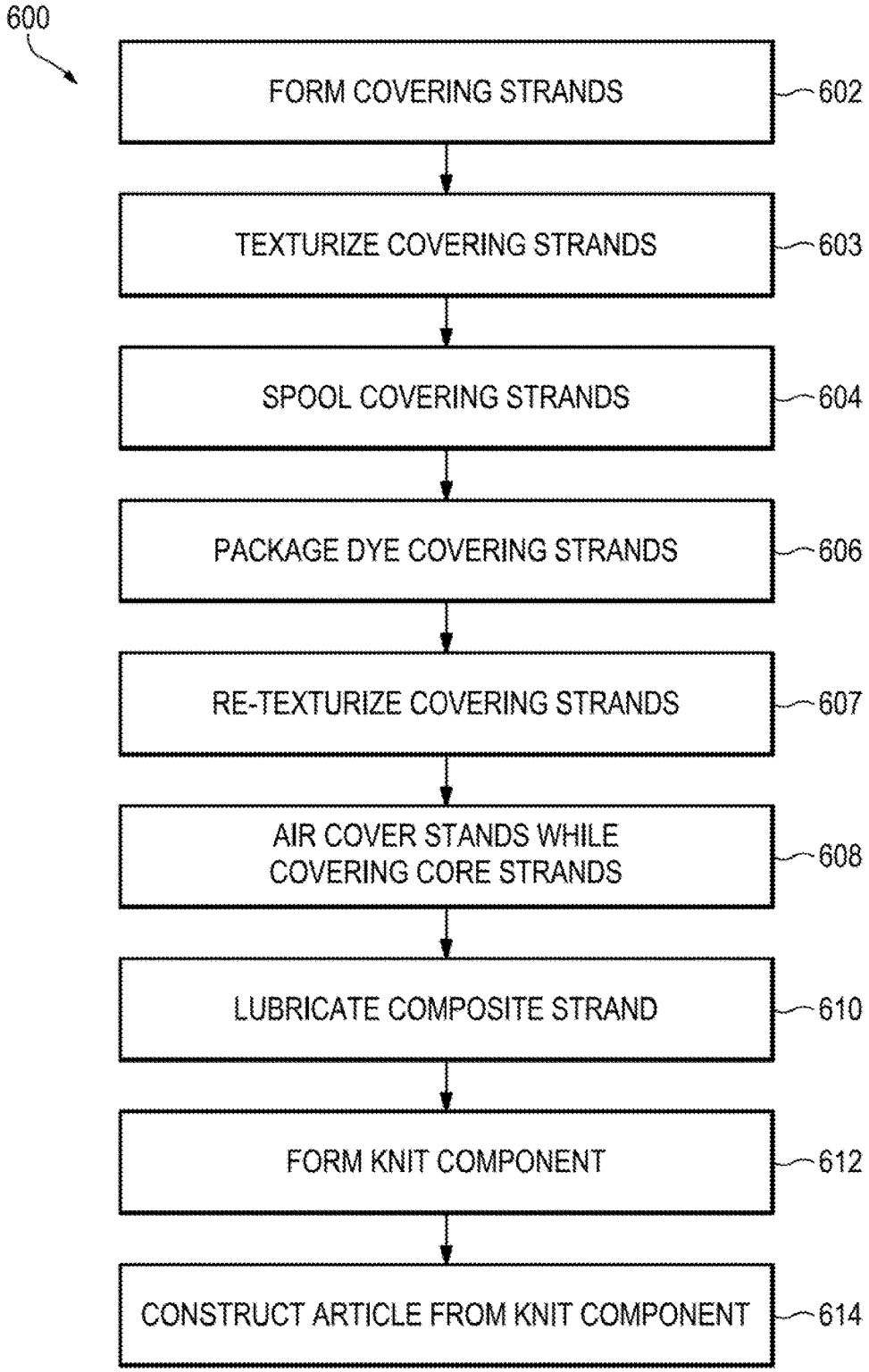
FIG. 6 is a flow chart of an exemplary manufacturing method for the knitted components of the present disclosure.

As shown in FIG. 6, exemplary methods 600 of manufacturing are illustrated. In these embodiments, the knitted component 400 is constructed from one or more composite yarns 508 as discussed above. However, it will be understood that the knitted component 400 could be constructed from other types of yarns 500 without departing from the scope of the present disclosure. Moreover, in the embodiments discussed below, the knitted component 400 is incorporated into an article of footwear 100 of the type discussed above. However, it will be appreciated that the knitted component 400 could be incorporated into other objects without departing from the scope of the present disclosure.

The method 600 can begin in step 602, wherein the covering strands 510 are formed. For example, as shown in FIG. 7, the covering strands 510 can be formed through a known extrusion process using an extruder 620.

The method 600 can then continue in step 603, wherein the covering strands 510 are texturized with a texturizing device 650. The texturizing device 650 can provide kinks, entanglements, twisting, braiding, or otherwise increase the thickness of the covering strands 510.

Figure 9:
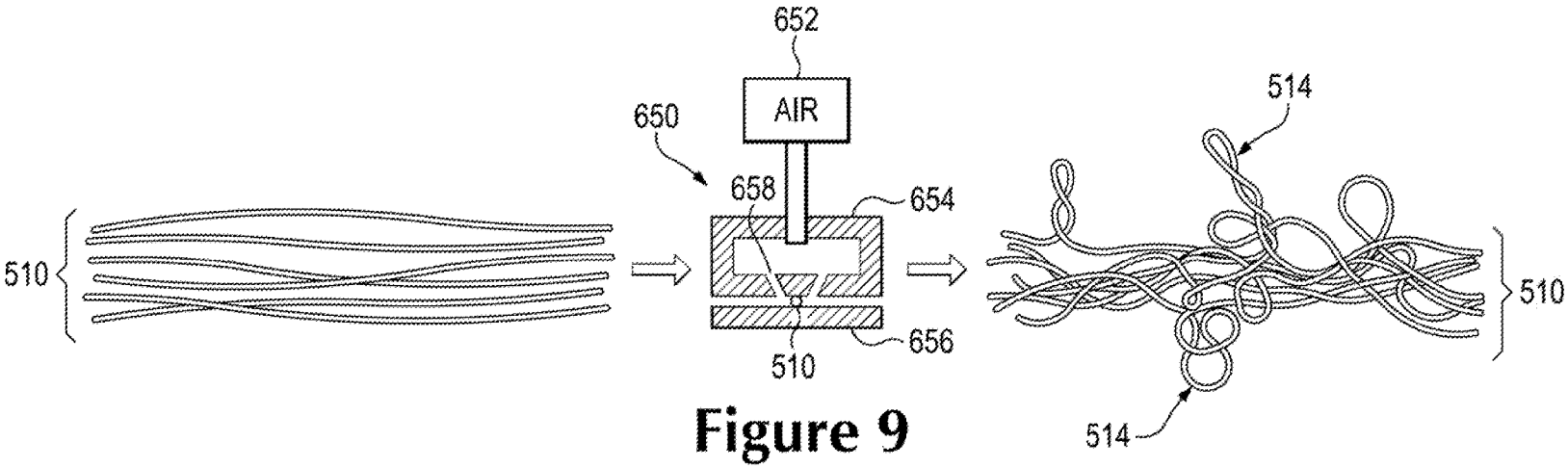
FIG. 9 is a schematic view of a texturizing device according to the method of FIG. 6.

FIG. 9 schematically illustrates the texturizing device 650 in greater detail according to exemplary embodiments. The texturizing device 650 can include a die 654, and a fluid passageway 658 can extend through the die 654. The fluid passageway 658 can be fluidly coupled to a compressed air source 652. The texturizing device 650 can also include a backing die 656. A plurality of covering strands 510 can be fed between the dies 654, 656 and high pressure air can be blown over the strands 510. Turbulence can increase kinking or crimping of the strands 510. Thus, as shown in FIG. 9, the strands 510 can exit the texturizing device 650 with increased kinking or other bulked regions 514.

Figure 7:
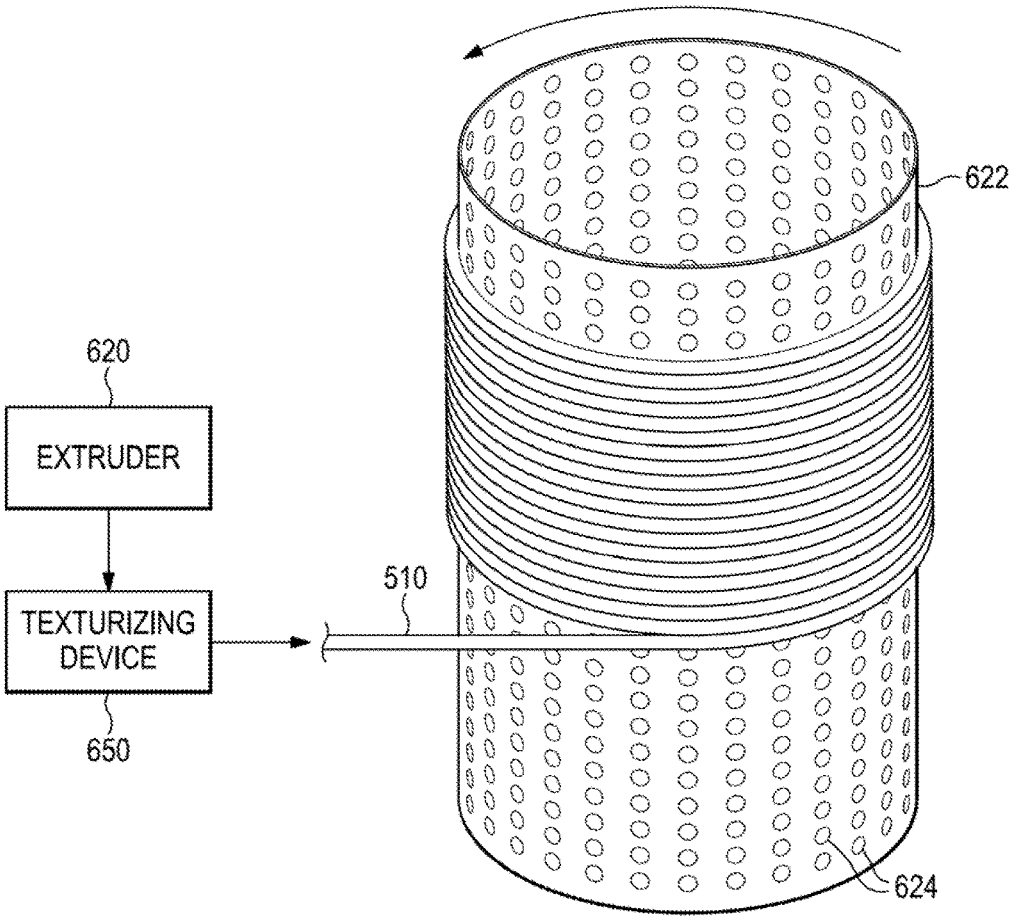
FIG. 7 is a schematic view of one or more yarns shown during the manufacturing method of FIG. 6.

Then, the method 600 can continue in step 604, as shown in FIGS. 6 and 7. In step 604, the strands 510 can be spooled on a spool 622. In some embodiments, the spool 622 can be a rigid and hollow tube, cone, or other shaped object. Also, the spool 622 can include a plurality of apertures 624 thereon. As shown in FIG. 7, the covering strands 510 can be helically coiled, spooled, and collected on the spool 622.

Next, as shown in FIG. 6, the method 600 can continue in step 606, wherein the covering strands 510 are package dyed to provide the strands 510 with a predetermined color. For instance, the covering strands 510 can be package dyed using a known package dye apparatus 630 of the type shown in FIG. 8.

The package dye apparatus 630 can include a dye vessel 634 having a support structure 632, and one or more of the spools 622 of the covering strands 510 can be supported on the structure 632. The package dye apparatus 630 can also include a plumbing system 636 that includes a series of pipes, valves, and the like. A pump 640 can be included for pumping dye or dye liquor through the plumbing system 636. The dye liquor can have any suitable color and concentration of dye. Lubricant can also be included in the dye liquor as well in some embodiments. Moreover, the apparatus 630 can include a flow regulator 642 for regulating the flow of the dye liquor through the plumbing system 636. Additionally, the apparatus 630 can include a heat exchanger 638 that can heat the dye liquor (e.g., to at least 135° C.). Furthermore, the dye apparatus 630 can include an expansion tank 644 that allows steam to escape from the plumbing system 636. Additionally, a drain 646 can be disposed downstream of the expansion tank 644.

During use, the package dye apparatus 630 can circulate heated dye liquor through the dye vessel 634 to thereby color the covering strands 510. The dye liquor can flow over the strands 510 and through the apertures 624 of the spool 622 to color the strands 510 uniformly. The dye liquor can be pumped over the strands 510 at a substantially high fluid pressure as well. Moreover, the dye can flow over the strands 510 for a predetermined amount of time. For example, in some embodiments, the strands 510 can be exposed to the dye liquor for at least forty-five minutes. In additional embodiments, the strands 510 can be exposed to the dye liquor for more or less time. The exposure time and other variables of the package dyeing process can be varied according to the desired color, dimension, or other characteristics of the strands 510.

Figure 18:
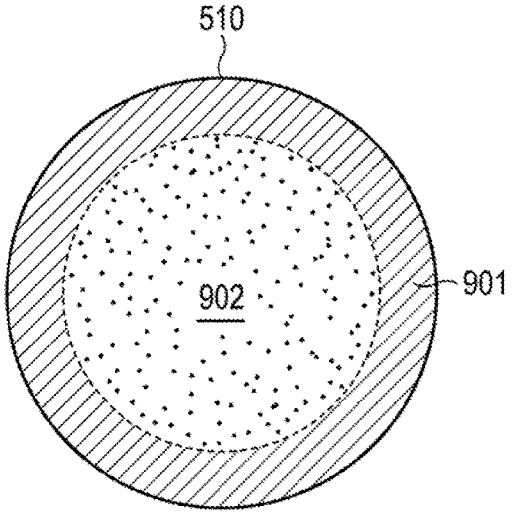
FIG. 18 is a cross sectional view of a package dyed yarn according to some embodiments of the present disclosure.

Once dyed, the color of the strand 510 can be substantially consistent through its cross section in some embodiments. In other embodiments represented in FIG. 18, the color of the strand 510 can vary through its cross section. More specifically, the strand 510 can have an outer zone 901 and an inner zone 902 that differ in color or shade. For example, the outer zone 901 can be darker in color, and the inner zone 902 can lighter or more pale. Specifically, in the case of a red strand 510, the outer zone 901 can be dark red while the inner zone 902 can be light red or pink. The variation in color through the cross section can be dependent upon the exposure time of the strand 510 to the dye liquor during the package dye process.

It will be appreciated that the package dyeing process can increase manufacturing efficiency, can reduce manufacturing costs, and can provide other similar advantages. However, because the strands 510 are exposed to high temperatures and high pressures, in some cases the package dyeing process may degrade the strands 510. For example, when a strand 510 is degraded, the degree of kinking or crimping of the strands 510 can be reduced. For example, the strands 510 can be reduced in thickness or bulk by up to 4% in some embodiments.

Thus, as shown in FIG. 6, the method 600 can continue in step 607, wherein the thickness and/or bulkiness of the strands 510 can be increased. In some embodiments, for example, the strands 510 can be re-texturized to increase kinking, crimping, and/or bulkiness of the strands 510. A texturizing device 650 of the type shown in FIG. 9 and described above can be used in some embodiments for re-texturizing the strands 510.

Figure 11:
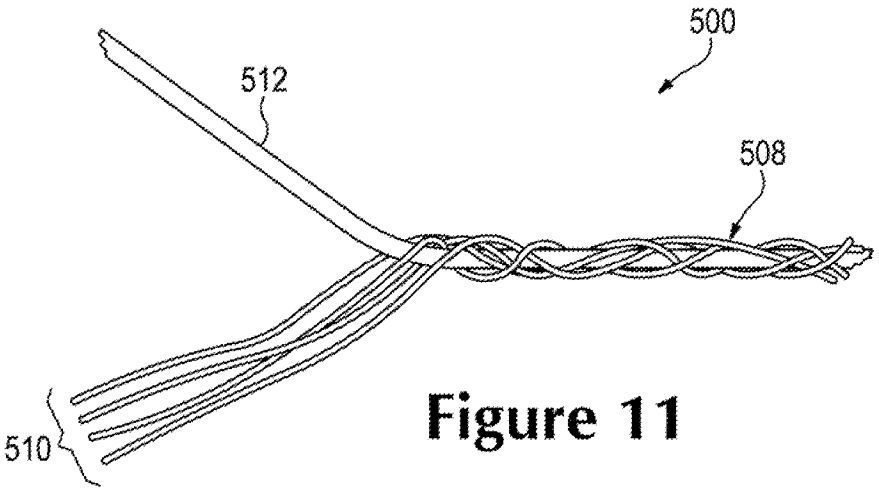
FIG. 11 is a schematic view of a composite yarn being formed according to the method of FIG. 6.

Next, the composite yarn 508 can be formed in step 608 of FIG. 6. This process is schematically illustrated in FIG. 11, wherein one or more core strands 512 are covered over by one or more of the covering strands 510.

Figure 10:
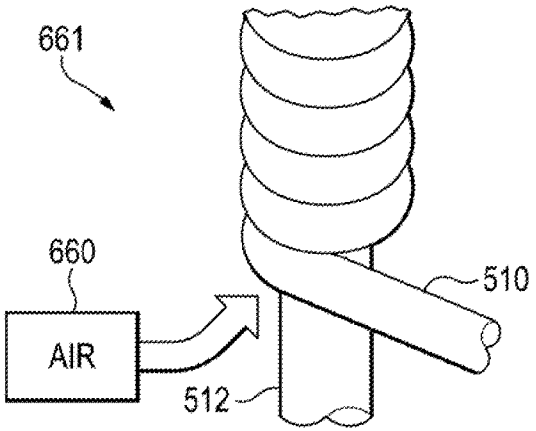
FIG. 10 a schematic view of a composite yarn being formed according to the method of FIG. 6.

In some embodiments, the composite yarn 508 can be formed in step 608 in a way that further increases the kinking, crimping, and/or bulkiness of the covering strands 510. For example, the composite yarn 508 can be formed using a so-called "air covering" process. An air covering device 661 is schematically illustrated in FIG. 10 according to exemplary embodiments. As shown, one or more covering strands 510 can be wound over the core strand 512 while air from an air source 660 blows high pressure air over the strand(s) 510. The high pressure air can further increase kinking in the covering strands 510, can increase entanglements in the covering strands 510, can increase crimping of the covering strands 510, or can otherwise increase the number of bulked regions 514 (FIG. 12) in the composite yarn 508.

In some embodiments, the texturizing process of step 607 and the air covering process of step 608 can be combined in a continuous process. For example, the strands 510 exiting the texturizing device 650 of FIG. 9 can be continuously fed toward the air covering device 661 of FIG. 10. Thus, the composite yarn 508 can be formed in an efficient manner.

The method 600 of FIG. 6 can continue in step 610. In step 610, the composite yarn 508 can be lubricated. The lubricant can be of any suitable type, and the lubricant can be applied to the yarn 508 in any suitable way. For example, the yarn 508 can be fed from a supply spool toward a take-up spool, and the yarn 508 can move through a container of lubricant as the yarn 508 is fed between the spools. The lubricant can also be sprayed on the yarn 508 in some embodiments, or the lubricant can be applied in other ways.

Figure 14:
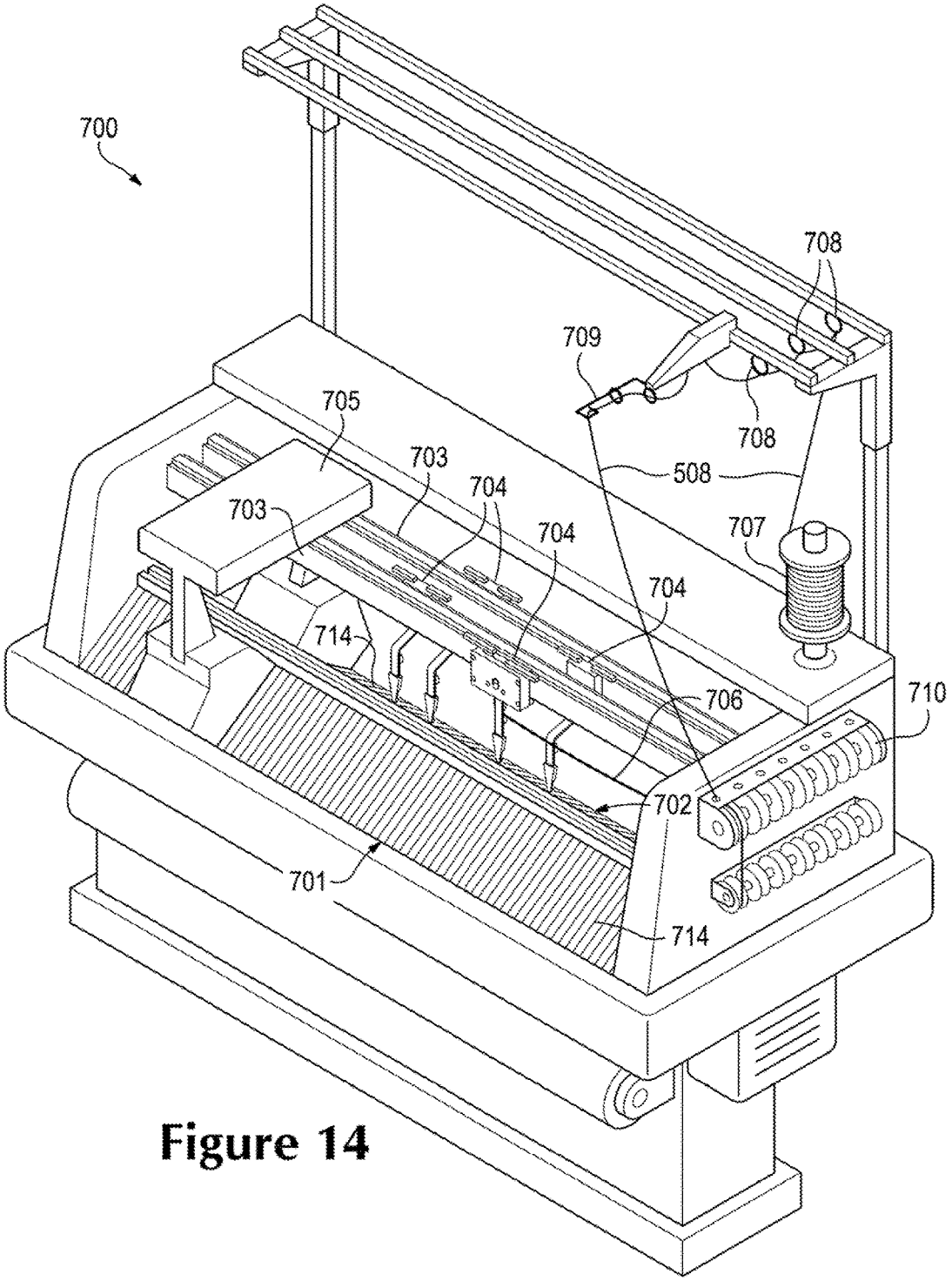
FIG. 14 is a perspective view of a knitting machine suitable for forming the knitted component according to the method of FIG. 6.

Next, as shown in FIG. 6, the method 600 can continue in step 612, wherein the knitted component 400 can be formed from one or more of the yarns 508 discussed above. For example, the knitted component 400 can be formed using an automated knitting machine 700 as shown in FIG. 14. The knitting machine 700 can be of any suitable type, such as a flat knitting machine of the type shown in FIG. 14.

As shown in the embodiments of FIG. 14, the knitting machine 700 can include two needle beds, including a front needle bed 701 and a back needle bed 702 that are angled with respect to each other, thereby forming a V-shaped bed. Each of front needle bed 701 and back needle bed 702 include a plurality of individual needles 714 that lay on a common plane. That is, needles 714 from the front needle bed 701, 702 lay on a first plane, and needles 714 from the back needle bed 702 lay on a second plane. The first and second needle beds 701, 702 are angled relative to each other and meet to form an intersection that extends along a majority of a width of knitting machine 700.

Figure 17:
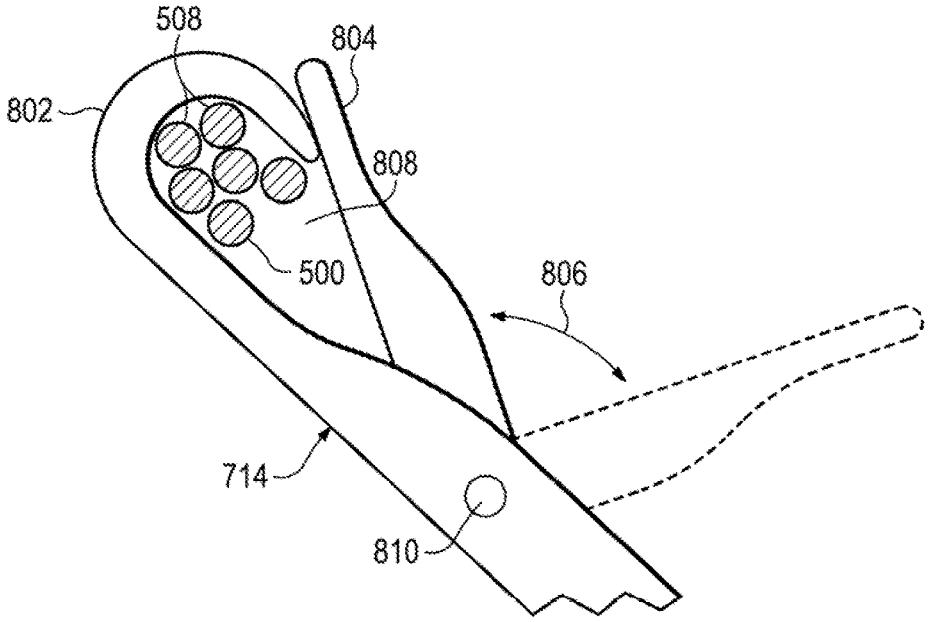
FIG. 17 is a side view of a needle of the knitting machine of FIG. 14.

As shown in FIG. 17, exemplary needles 714 can include a hook 802 and a latch 804. The latch 804 can be pivotally attached to the hook 802 at a hinge 810 so as to pivotally move between an unlatched position (shown in phantom) and a latched position (shown in solid lines). A hook area 808 can be defined between the hook 802 and the latch 804. One or more yarns 500, 508 can be received and held within the hook area 808 to be incorporated into the knitted component 400 as will be discussed below.

Referring back to FIG. 14, a pair of rails 703 extends above and parallel to the intersection of needle beds 701, 702 and provide attachment points for yarn feeders 704. Due to the action of a carriage 705, feeders 704 move along rails 703 relative to the needle beds 701, 702, thereby supplying yarns to needles 714. In FIG. 14, composite yarn 508 is provided to feeder 720 from a spool 707. More particularly, yarn 508 extends from spool 707 to various yarn guides 708, a take-back spring 709, and a yarn tensioner 710 before entering combination feeder 720. Although not depicted, additional spools 707 may be utilized to provide additional composite yarns 508 or other yarns, including yarns 500 to feeders 704, 720.

The feeders 704 can supply the yarn 508 to the needles 714, and the needles 714 can knit, tuck, and float the yarn 508 to form the knitted component 400. In some embodiments, the feeder 704 can be configured to inlay the yarn 508 within the knitted component 400 as well. For more details of a feeder for performing such inlaying, see U.S. Patent Publication Number 2012/0234052 to Dua et al., entitled "Method of Manufacturing a Knitted Component", published on Sep. 20, 2012, which is hereby incorporated by reference in its entirety.

Figure 15:
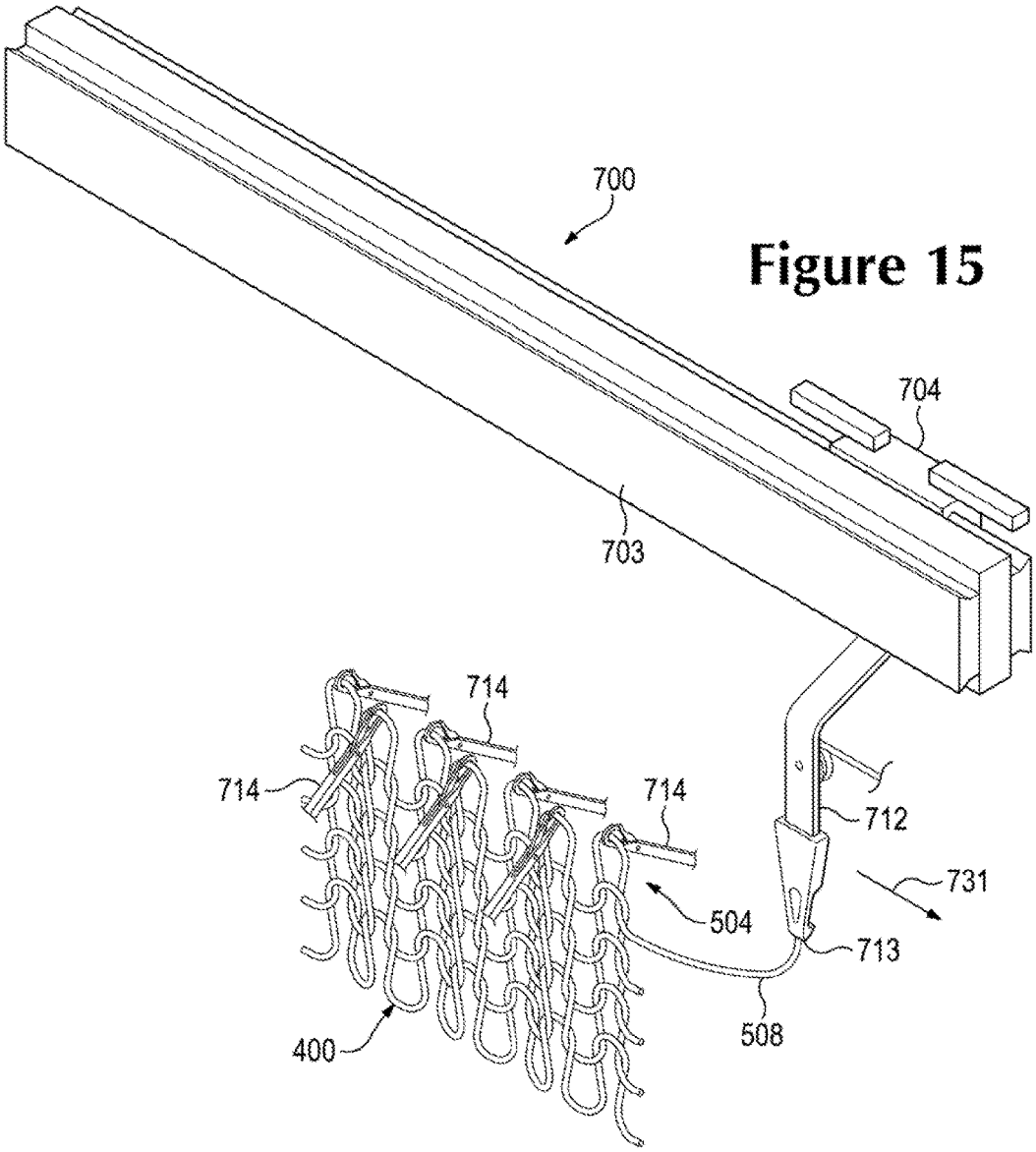
FIG. 15 is a schematic view of a needle bed and feeder shown forming the knitted component.
Figure 16:
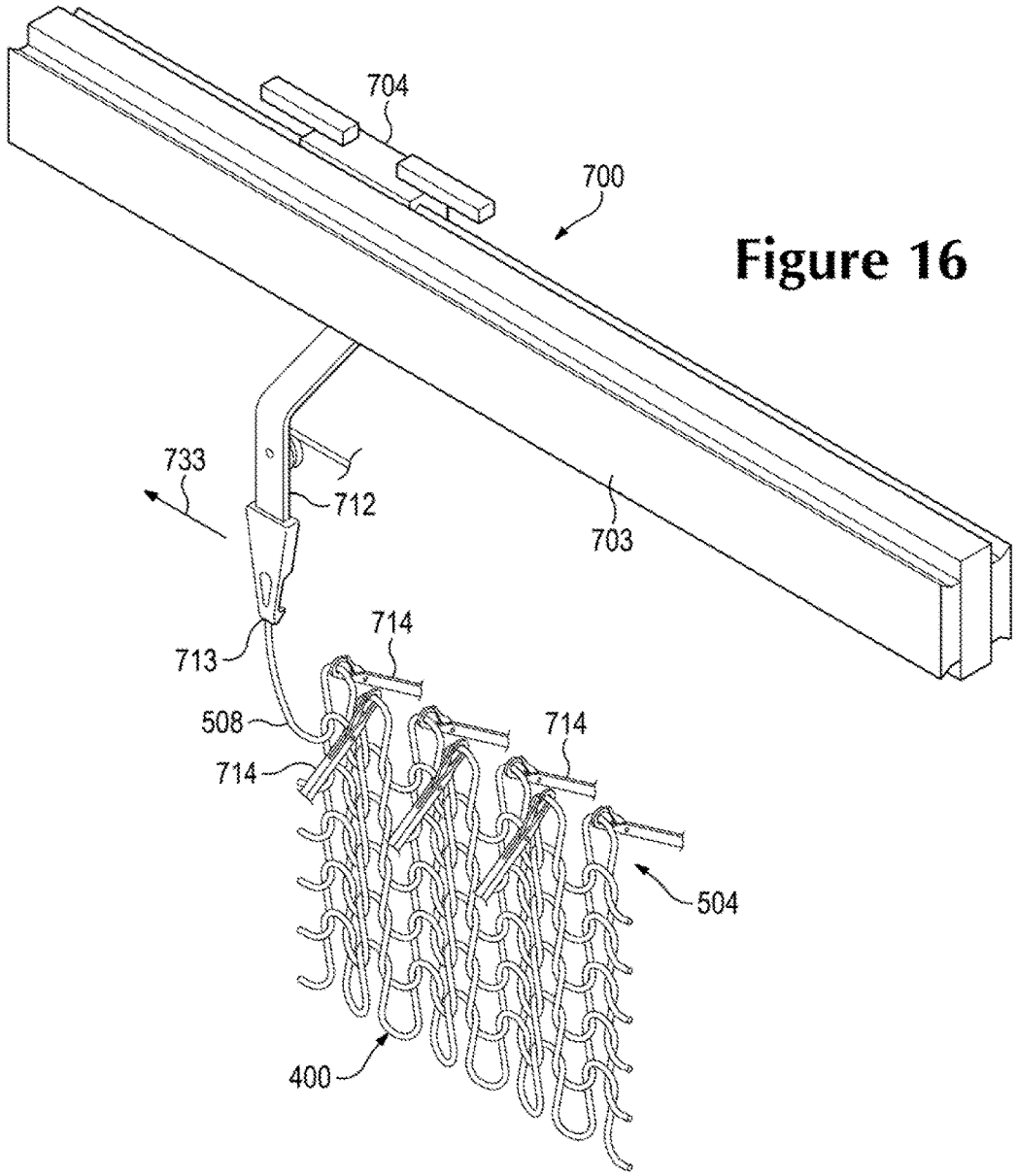
FIG. 16 is a schematic view of the needle bed and feeder shown forming the knitted component.

FIGS. 15 and 16 illustrate exemplary embodiments of the process of knitting using the knitting machine 700. The knitting process discussed herein relates to the formation of knitted component 400, which may be any knitted component, including knitted components that are similar those shown in FIGS. 1-5. For purposes of the discussion, only a relatively small section of knitted component 400 is shown in FIGS. 15 and 16 in order to permit the knit structure to be illustrated. Moreover, the scale or proportions of the various elements of knitting machine 700 and knitted component 400 is enhanced to better illustrate the knitting process.

As shown in FIG. 15, the feeder 704 can move along rail 703 in a first direction 731 and feed the yarn 508 toward the needles 714. More particularly, needles 714 extend from the respective needle bed 701, 702 to receive sections of the yarn 508, and the needles 714 move the respective sections of the yarn 508 through the loops of the prior course 504, thereby forming a new course 504. As shown in FIG. 16, the feeder 704 can also move in a second direction 733 opposite the first direction 731 to form even more courses 504 in the knitted component 400. This process can be repeated, and the knitted component 400 can grow to a predetermined size.

Once the knitted component 400 is formed, the method 600 can continue in step 614 as shown in FIG. 6. In step 614, an object, such as the article of footwear 100 of FIG. 1 can be constructed. For instance, the knitted component 400 can be formed into the upper 120 of the article of footwear 100. Then, the sole structure 110 can be operably secured to the upper 120. As discussed above, the sole structure 110 can include a midsole and an outsole, and both can be operably attached in step 614. The sole structure 110 can be secured to the upper 120 via adhesives, fasteners, or other attachment devices. The laces 122 can also be added as well as logos, information tags, and the like. Moreover, the footwear 100 can be subjected to other post-processing, such as steaming to thereby fuse any fusible yarns 500 knitted within the knitted component 400.

Forming Dense Knit Structure from Package Dyed Yarns

Figure 8:
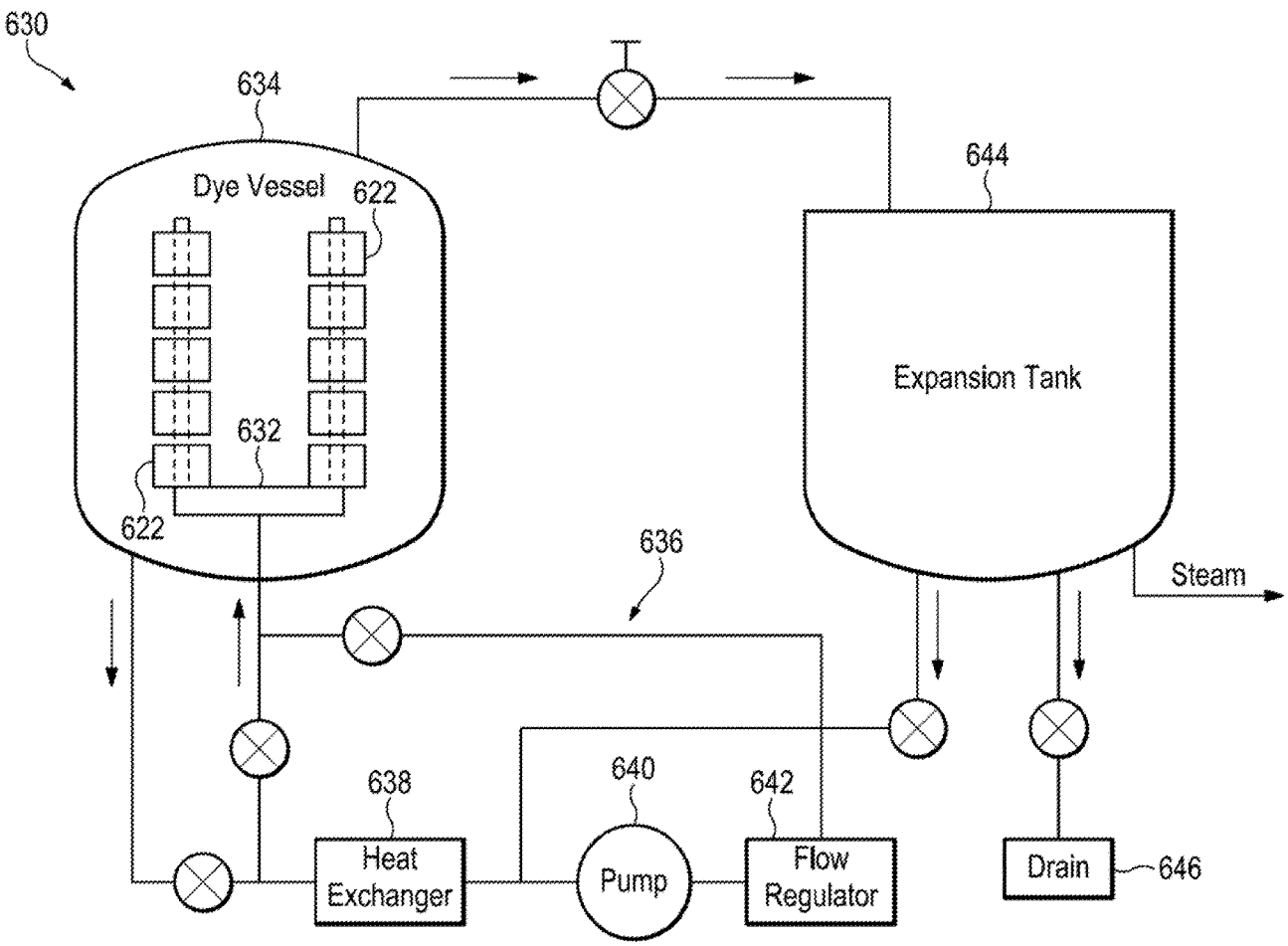
FIG. 8 is a schematic view of a package dyeing apparatus according to the method of FIG. 6.

As described above, the yarns 508 of the knitted component can be colored at least partially through package dyeing processes (FIG. 8). This can increase manufacturing efficiency and reduce manufacturing costs. However, the package dyeing process can reduce the bulk, diameter, and/or thickness of the yarn 508. Also, the package dyeing process can reduce bulked regions 514 in the yarn 508, and the elasticity of the yarn 508 can be reduced as a result. Thus, in some embodiments, the yarns 508 can be texturized before the package dye process and then re-texturized and air covered after the package dye process as described above. These processes can increase the thickness 501 of the yarns 508 and can increase the amount of bulked regions 514 in the covering strands 510. Also, by increasing the amount of bulked regions 514, the yarn 508 can be made more elastic and stretchable.

In some embodiments, yarns 508 can have a thickness 501 of at least 0.30 millimeters when pulled under 5 grams of tension before the package dye process. The dyeing process can reduce the thickness 501 of the yarns 508; therefore, the yarns 508 can be texturized and/or air covered to increase the thickness 501 from the reduced thickness back to a thickness of at least 0.30 millimeters.

In additional embodiments, the yarns 508 can have a thickness 501 of approximately 0.40 millimeters under 5 grams of tension upon exiting the extruder 620. In some embodiments, these yarns 508 can be so-called "partially oriented yarns," and these yarns 508 can be pulled or drawn to orient the molecules within the yarns 508. As a result, the thickness 501 can reduce to approximately 0.35 millimeters under 5 grams of tension. Then, the yarns 508 can be texturized in step 603 to increase the thickness 501 back to approximately 0.40 millimeters under 5 grams of tension. Next, the yarns 508 can be package dyed in step 606. This can reduce the thickness of the yarns 508 to approximately 0.38 millimeters under 5 grams of tension. Subsequently, the yarns 508 can be re-texturized and/or air covered in steps 607 and 608. Specifically, the yarns 508 can be re-texturized in step 607 to increase the thickness 501 back to approximately 0.40 millimeters under 5 grams of tension. Air covering in step 608 can increase the thickness of the yarns 508 even further. Then, the method can continue, for example, by forming the knitted component from the yarns 508.

These processes can allow the knitted component to have desirable appearance, softness, and other qualities. Also, these processes can allow the knitted component to be more densely knit (i.e., to have a greater number of courses and wales per unit of area and/or a greater number of stitches per unit of area). For example, the yarns 508 may need to be stretched and elongated during knitting processes so that they reduce in thickness 501 (compare FIGS. 12 and 13), and this reduction of size can allow the yarns 508 to fit within a densely knit area.

Also, this reduction in thickness 501 of the yarn 508 can cause the yarn 508 to occupy less area within the hook area 808 of the needle 714 during knitting. As such, there can be more available space for yarns 508 within the hook area 808. For example, as shown in FIG. 17, there are five yarns 508 within the hook area 808 of the needle 714. Also, in the case of a tuck stitch 507 (FIG. 2), the needle 714 can hold these yarns 508 as a successive course 504 is formed. Thus, the needle 714 can hold ten yarns 508 while a tuck stitch 507 is formed. Such tuck stitches 507 might be included, for example, at areas of transition between a mesh-type knitted pattern and a densely knit area of the upper 120.

In some embodiments, at least a portion of the knitted component 400 can be relatively densely knit. For example, in the case of the upper 120 of FIG. 1, certain portions can be more densely knit than others such that those portions can provide increased support to the wearer's foot. In some embodiments, the heel region 103 of the upper 120 can have particularly high stitch density such that the heel region 103 can support the wearer's heel. For example, the heel region 103 can have a density of at least four hundred stitches per square inch (400 stitches/in$^2$). In additional embodiments, the stitch density of the heel region 103 can be at least four hundred fifty stitches per square inch (450 stitches/in$^2$) or higher. In still additional embodiments, the heel region 103 can have a stitch density of at least four hundred eighty stitches per square inch (480 stitches/in$^2$). Also, in embodiments in which the knitted component 400 is a flat knitted component, the heel region 103 can have a density of at least twenty-eight courses per inch (28 CPI). In this regard, these stitch densities can provide the heel region 103 with sufficient stiffness and strength to support to the wearer's foot. These stitch densities can also provide sufficient durability for the heel region 103 without substantially increasing weight of the upper 120. Other regions of the upper 120 can have high stitch density as well. Moreover, other regions of the upper 120 can have particularly low stitch density (e.g., mesh-type knitted areas).

To form such densely knit knitted components 400, the yarns 508 of the knitted component can be pulled to a predetermined tension as the knitting machine 700 knits the knitted component 400. For instance, the tensioner 710 (FIG. 14) can maintain tension in the yarn 508 to between approximately ten grams (0.098 Newtons) and sixty grams (0.588 Newtons) as the yarn 508 is incorporated into the knitted component 400. In additional embodiments, the tensioner 710 can maintain between approximately forty grams (0.392 Newtons) and sixty grams (0.588 Newtons) of tension in the yarn 508. This tension can elongate the yarn 508 and can also reduce the diameter of the yarn 508 such that the yarn 508 can better fit within the hook area 808 of the needle 714 and within the densely knit construction of the knitted component 400.

Moreover, the knitting machine 700 can be configured to further increase the density of the knitted component 400. For example, in some embodiments, the knitting machine 700 can be configured to accept needles 714 of a predetermined gauge. However, larger gauge needles 714 can be used in some embodiments to increase the density of the knitted component 400. For example, the knitting machine

700 can be a fourteen gauge machine, meaning that the machine 700 is configured to accept fourteen needles 714 per inch along the needle beds 701, 702. In an exemplary embodiment, ten gauge needles can be used in place of the fourteen gauge needles such that the hook area 808 of the ten gauge needle is larger than normal, i.e., larger than the corresponding hook area of the fourteen gauge needle. As such, the hook area 808 of the ten gauge needle can accept more yarns, and the resulting knitted component 400 can have a higher density.

Thus, the above disclosure can facilitate such dense knitting of the knitted component 400 using at least partially package dyed yarns 500, 508, 510. Thus, the knitted component 400 (e.g., the upper 120 of FIG. 1) can be produced at reduced cost. However, the quality of the knitted component 400 can be maintained.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

What is claimed is:

1. An article of footwear comprising:

a sole assembly; and an upper that is attached to the sole assembly, the upper including a flat knitted component, the flat knitted component formed of unitary knit construction, the flat knitted component including an area that is formed from a yarn, the yarn being at least partially package dyed, and the area having a density of at least twenty-eight courses per inch (28 CPI), and wherein the yarn has a first cross-sectional thickness before being at least partially package dyed and has a second cross-sectional thickness after being at least partially package dyed that is less than the first cross-sectional thickness, and wherein the yarn that is at least partially package dyed is texturized to a third cross-sectional thickness that is greater than the second cross-sectional thickness prior to knitting the yarn into the flat knitted component.

2. The article of footwear of claim 1, wherein the area has a stitch density of at least four hundred stitches per square inch (400 stitches/in$^2$).

3. The article of footwear of claim 2, wherein the area has a stitch density of at least four hundred fifty stitches per square inch (450 stitches/in$^2$).

4. The article of footwear of claim 3, wherein the area has a stitch density of at least four hundred eighty stitches per square inch (480 stitches/in$^2$).

5. The article of footwear of claim 1, wherein the yarn is a composite yarn including a covering strand, wherein the composite strand further includes a core strand, and wherein the covering strand at least partially covers the core strand.

6. The article of footwear of claim 5, wherein the core strand is resiliently elastic, and wherein the composite yarn is resiliently stretchable between a first length and a second length.

7. The article of footwear of claim 1, wherein the package dyed yarn is incorporated within the area in a tuck stitch.

* * * * *